United States Patent [19]

Ottinger

[11] 4,028,830

[45] June 14, 1977

[54] SNOWING FIXTURE

[76] Inventor: Dwight M. Ottinger, 1777 Wren St., Corona, Calif. 91720

[22] Filed: Apr. 5, 1973

[21] Appl. No.: 348,006

[52] U.S. Cl. ..... 40/106.25; 272/15

[51] Int. Cl.[2] ..... G09F 19/02

[58] Field of Search ..... 40/106.25; 272/15

[56] References Cited

UNITED STATES PATENTS

| | | | |
|---|---|---|---|
| 901,319 | 10/1908 | Bruen | 272/15 |
| 2,176,139 | 10/1939 | Lofgren | 251/145 |
| 3,147,175 | 9/1964 | Gonzalez | 272/15 UX |
| 3,415,512 | 12/1968 | Burnbaum | 40/106.25 X |
| 3,415,513 | 12/1968 | Burnbaum | 40/106.25 X |
| 3,777,330 | 12/1973 | Van Huffel | 15/421 |

OTHER PUBLICATIONS

Kirk–Othmer, Encyclopedia of Chemical Technology, (2nd Ed.), vol. 1, pp. 10 and 11.

Uses and Applications of Chemical and Related Materials, Reinhold Publishing Corp., pp. 582 and 583.

*Primary Examiner*—John F. Pitrelli

[57] ABSTRACT

A fixture for simulating falling snow has a catch basin where the simulated snow is accumulated, a power operated pump for withdrawing the simulated snow particles from the catch basin and a distributing conduit into which the simulated snow is pumped and from which individual particles are ejected so as to flutter downwardly back to the catch basin. To make certain that the particles act separately and in a natural fashion, a separate air inlet is provided adjacent the pump intake into which an abundance of fresh air is drawn for ultimate mixing with simulated snow particles preventing the particles from sticking together during the travel through the distributor pipe and ultimate ejection from it.

7 Claims, 9 Drawing Figures

SNOWING FIXTURE

A display which has attracted the interest of many, especially during the holiday season, has been one simulating snow snowing on trees and particularly on Christmas trees. The idea broadly, however, has not been limited solely to Christmas trees in particular but has been applied to other sales and advertising displays.

Although the idea broadly of a snowing fixture has sundry obvious elements about it, certain difficulties have been encountered, first, in producing a realistic snowstorm effect and, secondly, in maintaining such a fixture in contant operation for a necessary period of time.

One of the outstanding problems has been inability on the part of such designers to keep simulated snow particles flowing constatnily into the intake side of a pump so that there is always a dependable supply of particles to be pumped upwardly to the area of discharge.

Another difficulty has been a dependable distribution of particles so that the snowing effect is constant and realistic rather than having it occur in an uncontrolled fall followed by periods when there would be no assurance of the simulated snowfall starting again in a reliable sequence. Particles, after they have fallen and accumulated in an appropriate catch basin, are such that they tend to bridge and fail to flow evenly to a bottom location for being picked up by the pump inlet conduit.

Another extremely troublesome difficulty experienced in making use of simulated snow particles made from one or another of an appropriate synthetic plastic resin has been what can readily be defined as a super abundance of static electricity. This effect has, in fact, been so troublesome that not even mechanical agitation of the entire mass in the catch basin has been sufficient to keep the particles flowing at any dependable rate to the pump intake. Further attempts to remedy the difficulty by vibrating the mass of synthetic plastic resin particles has met with only indifferent success. The need for additional mechanism, whether it be a vibrator or physical agitator, has added to the cost of such fixtures and the accompanying noise of mechanical movement or vibration has an appreciable detrimental effect.

it is therefore among the objects of the invention to provide a new and improved snowing fixture wherein the supply of synthetic snow particles to pump intake is kept dependable, smooth and constant.

Another object of the invention is to provide a new and improved snowing fixture wherein the particles after entering the pump and thereafter passing to the points of distribution are kept amply separated, one from another, to the end that the particles however small travel singly surrounded by a film of air so that they act more realistically, like actual snowflakes.

Still another object of the invention is to provide a new and improved snowing fixture which is of such structure that the detrimental effects of static accumulation on the particles is overcome without need for installing and employing additional mechanical means.

Still further among the objects of the invention is to provide a new and improved snowing fixture wherein there is such adequate control over the simulated snow particles that they can be handled in a catch basin of any one of a wide variety of shapes, sizes and depths and can be passed to an elevated point of distribution spread over an appreciable area so that a widespread snowfall can be simulated when needed.

Also included among the objects of the invention is to provide a new and improved snowing fixture the mechanical parts of which have been kept substantially to a minimum and in a simplified arrangement which lends itself to displays in wide variety.

With these and other objects in view, the invention consists in the construction, arrangement, and combination of the various parts of the device, whereby the objects contemplated are attained, as hereinafter set forth, pointed out in the appended claims and illustrated in the accompanying drawings.

Figure 1:
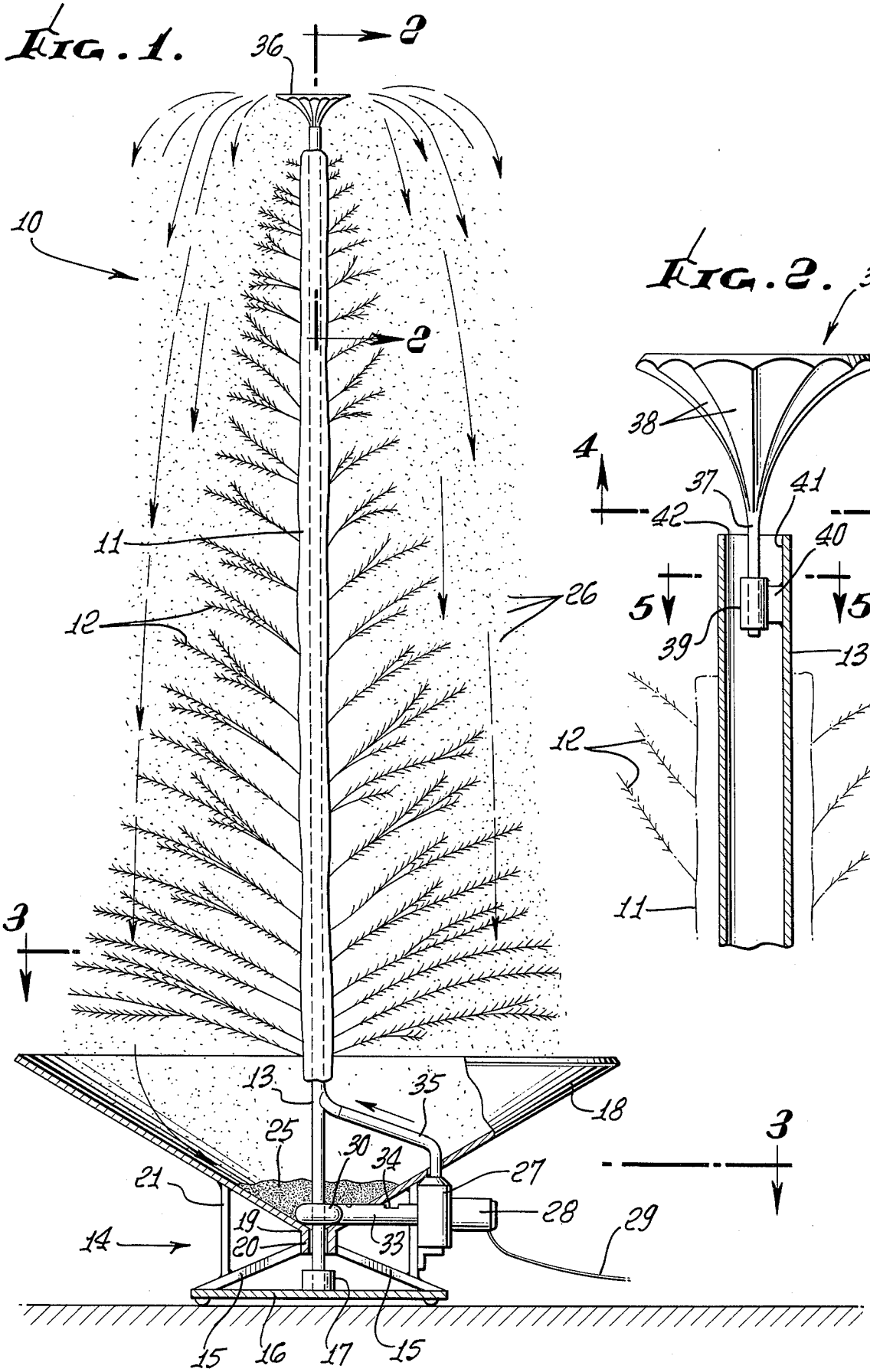
FIG. 1 is a side elevational view of a completely assembled fixture partially broken away.
Figure 2:
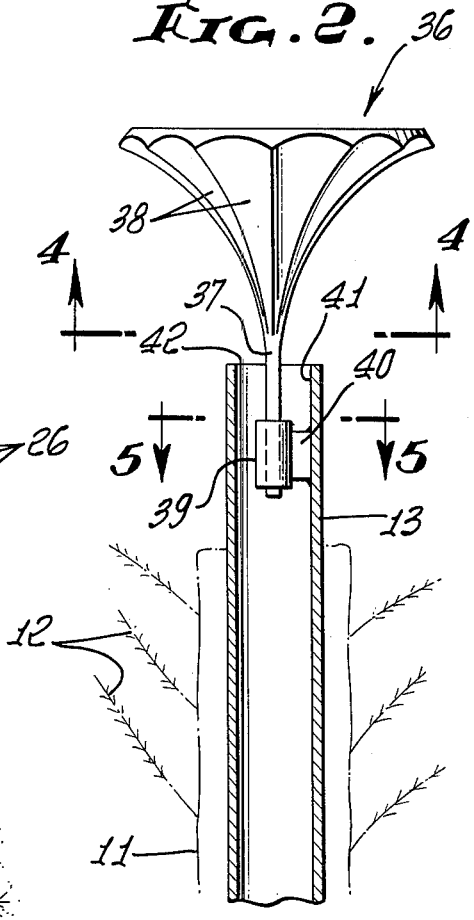
FIG. 2 is a fragmentary vertical sectional view on the line 2—2 of FIG. 1.
Figure 3:
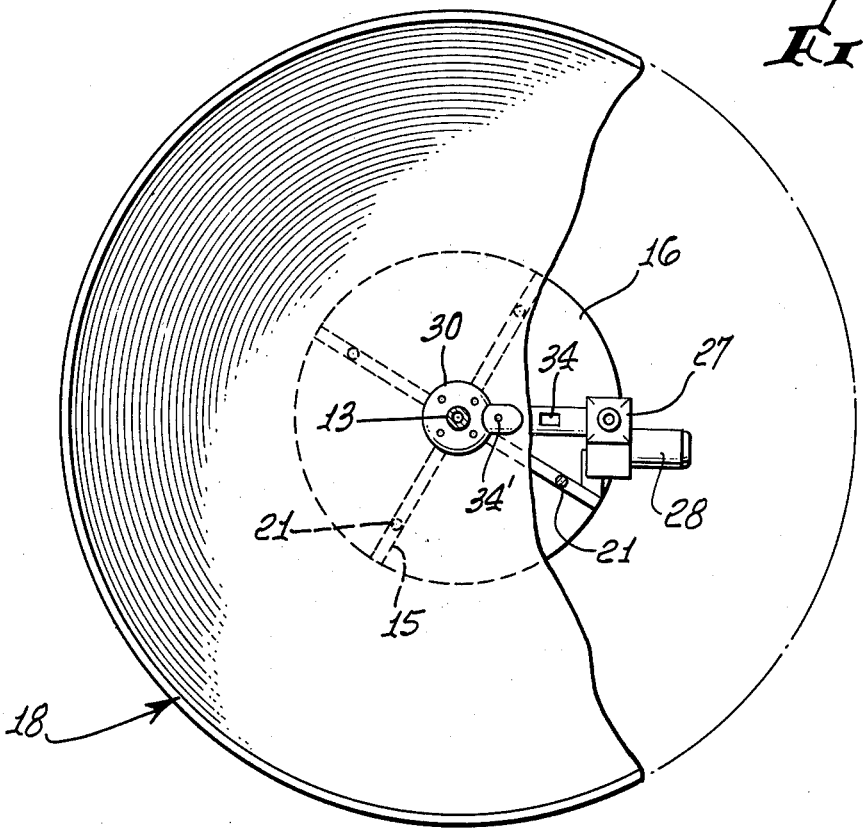
FIG. 3 is a cross sectional view on the line 3—3 of FIG. 1.
Figure 4:
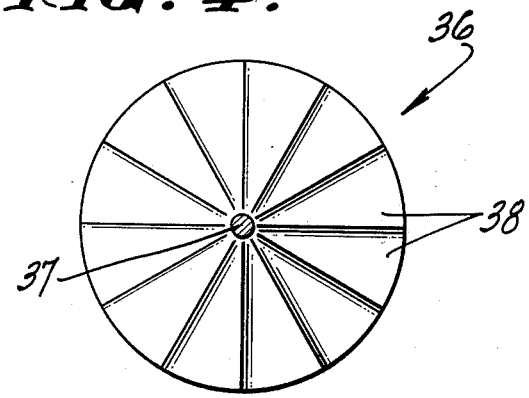
FIG. 4 is a cross sectional view on the line 4—4 of FIG. 2 looking in an upward direction.
Figure 5:
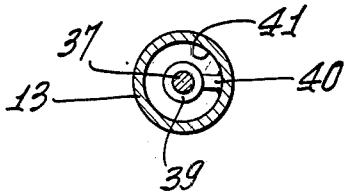
FIG. 5 is a cross sectional view on the line 5—5 of FIG. 2 looking in a downward direction.
Figure 6:
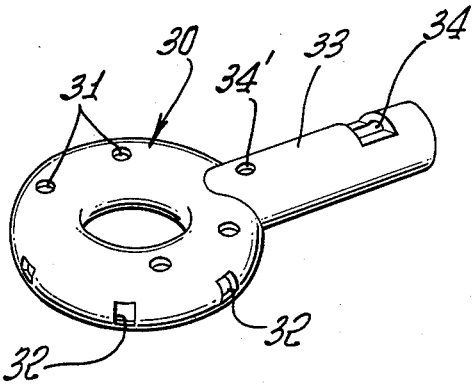
FIG. 6 is a side perspective view of the intake conduit assembly of FIG. 1.

In one embodiment of the invention chosen for the purpose of illustration, there is shown a fixture generally in the form of a tree indicated by the reference character 10 possessed of a trunk 11 and branches 12. Extending centrally through the trunk is a riser pipe 13, which may extend within the confines of the trunk 11 as shown or, should it be desired, actually constitute the trunk of the tree. A supporting stand 14 is made use of to support the riser pipe 13 and hence the trunk 11 in vertical position.

In the present embodiment the stand consists of diagonal braces 15 and a floorplate 16, with the riser pipe bottomed in a flange 17 on the top surface of the floorplate. In this manner the tree is self-supporting.

A catch basin 18 is substantially in the form of an inverted cone having its downwardly directed apex 19 resting on a collar 20 which is made fast to the riser pipe 13. To stabilize the mounting of the catch basin on the riser pipe, additional braces 21 may be employed.

To provide a snowing effect use is made of a mass 25 of fine particles 26 which when falling have the appearance of falling snow. Such particles may be one or another of the commercially available synthetic plastic resin material of such character that it can be produced in the form of flakes, beads, discs, rings or of other appropriate physical form provided that it be of a type which falls slowly with a somewhat fluttering motion from the top of the tree downwardly into the catch basin 18. An acceptable example is polystyrene foam in the form of beads.

To minimize the accumulation of electrostatic effect on the particles during operation a powder ingredient such as talc is mixed with the particles 26. An acceptable proportion is about 4 oz of talc to 10 pounds of particle. Periodic replenishment of the talc may become advisable should the electrostatic effect build up.

To move the particles from the catch basin upwardly, use is made of a pump 27 operated by an electric motor 28 supplied by an electric powerline 29. At the bottom of the catch basin is a particle inlet means 30 somewhat doughnut-like in shape and provided with upwardly directed inlet openings 31 spaced circumferentially about the upper face of the doughnut and lower inlet slots 32, likewise circumferentially spaced. Connecting the particle inlet means 30 with the pump 27 is an intake conduit 33.

Of special significance is the presence of a pure air intake 34 and the auxiliary air intake 34' in the intake conduit 33 located more or less adjacent the wall of the catch basin 18 but, in particular, with the air intake 34 located outside the catch basin 18 and entirely clear of the mass 25 of particles. Considering the angle of repose of the particles 26 to be at about 30° the inlet opening 31 and auxiliary air inlet 34' are located to be within the mass of particles as that mass varies from time to time during operation.

For passing the particles upwardly with respect to the riser pipe, there is provided a distributor conduit 35 connected at one end to the pump 27 and at the other end to the riser pipe 13 which, in effect, forms part of the distributor conduit.

At the top of the riser pipe 13 is a deflector 36 supported upon a stem 37, the deflector on its underside comprising a series of arcuate concave fluted surfaces 38. A sleeve 39 is attaced by means of a bracket 40 to the inside wall 41 of the riser pipe 13. The stem 27 rests removably in the sleeve 39. It is advisable to have the flutes deeply concave namely with the depth at the wide outer end about one half the width, and also angled slightly upwardly at the outer end. So constructed and proportioned most of the particles are forced toward the centerline of each respective flute and are flung upwardly as well as outwardly. That way the baffle can be kept relatively small and non-obtrusive while at the same time creating a wide pattern of snow fall.

In the operation of this form of the device, the pump acts to draw a mixture of particles 26 and air inwardly through the inlet openings 31 and inlet slots 32. Simultaneously a very substantial proportion of ambient air is drawn by the pump inwardly through the pure air intake 34 so that it immediately sets up a turbulence in the intake conduit 33 serving to keep the particles 26 of the synthetic plastic resin material separated one from another and, in effect, bouncing about as they enter the chamber of the pump 27. From there the particles, in company with what may aptly be described as a super abundance of air, are expelled outwardly and upwardly through the distributor conduit 35 until the mixture is blown upwardly and outwardly through a discharge opening 42 at the top of the riser pipe 13. At that point there is a sufficient abundance of air and particles to promote a scattered angularly upward distribution of individual particles outwardly from the deflector plate with sufficient force to have them disperse at random over a limited area adjacent the top of the tree from which, after arcing over, they flutter down through the branches until they fall again into the catch basin 18.

Figure 7:
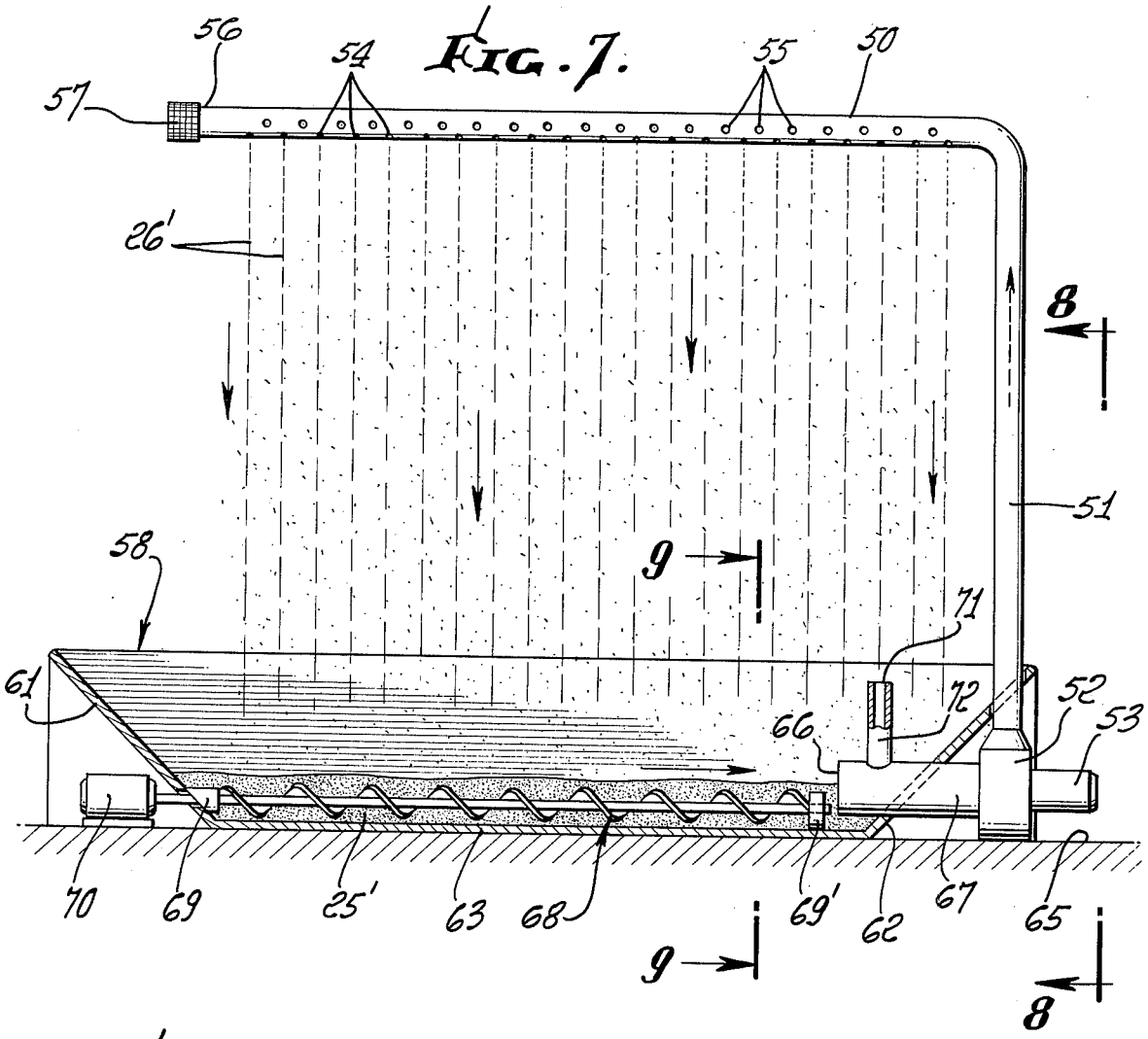
FIG. 7 is a side elevational view partly in section showing a second form of the fixture.
Figure 8:
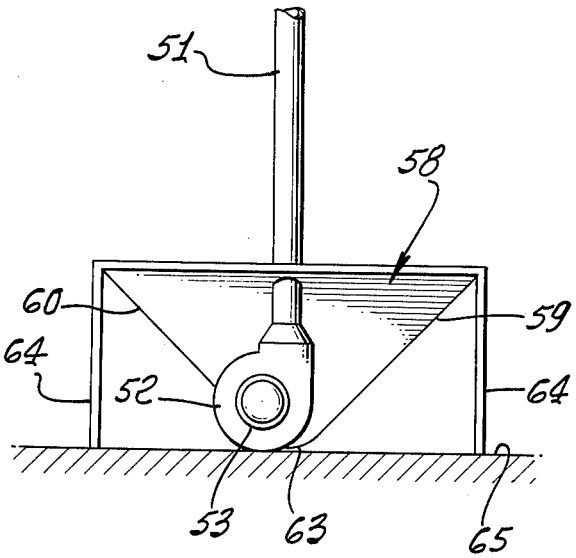
FIG. 8 is an end elevational view on the line 8—8 of FIG. 7.
Figure 9:
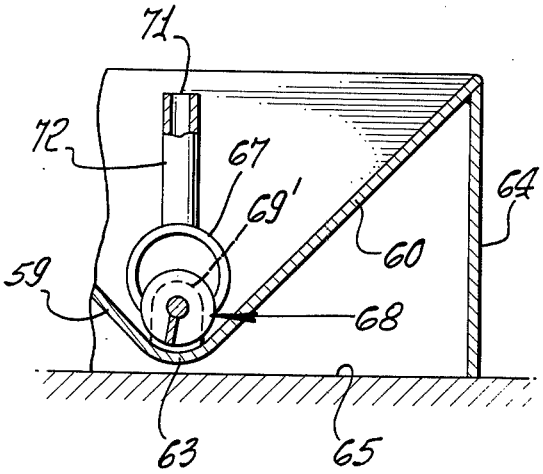
FIG. 9 is a fragmentary vertical sectional view on the line 9—9 of FIG. 7.

By having a super abundance of air thereby to separate the individual particles one from another, friction between particles is avoided thereby to avoid the creation of an unwanted amount of static charges so that when the particles finally fall into the catch basin, they tend to act and flow like separate particles into the bottom of the catch basin where they are again picked up by the intake conduit as initially described.

Where a particle fall of different form is desired, an elongated dispersal tube 50 of the type shown in FIG. 7 is found useful. The dispersal tube is supplied by a riser pipe 51 connected to a pump 52 driven by an electric motor 53. Longitudinally spaced along the dispersal tube 50 is a series of outlet ports 54 which may be directed downwardly or angularly outwardly and downwardly as suggested by the outlet ports 55. The free end 56 of the dispersal tube is open but guarded by a screen 57 so that air can be discharged outwardly from the free end and whereby the particles 26' are prevented from being discharged at that location. The particles 26' are of the same character as already described in connection with the first described form of the invention.

In this form of the device an elongated catch basin 58 is employed which has sloping side walls 59 and 60 and sloping end walls 61 and 62, the walls sloping obliquely downwardly and inwardly to an arcuate bottom 63. Panels 64 may be employed to support the catch basin on a supporting surface 65.

Since there is considerable distance between the end of the elongated catch basin remote from the pump 52 and the end adjacent the pump, means is provided for moving the mass 25' of particles to a position adjacent an open inlet end 66 of an inlet conduit 67 to the pump.

An auger 68 is mounted at opposite ends in bearings 69 and 69' supported by the catch basin, so the auger rotates in a horizontal plane close to the bottom 63 of the catch basin.

A motor 70, located outside of the catch basin and resting upon the suppporting surface 65, rotates the auger in the direction such that it feeds particles of the mass 25' in a direction from left to right, as viewed in FIG. 7, into the inlet end 66 of the inlet conduit 67.

Here also, as in the previously described form of the invention, there is installed a pure air intake 71 at the top of a stand pipe 72 which feeds into the inlet conduit 67 intermediate the inlet end 66 and the pump 52. By having the stand pipe 72 high enough, the mass 25' of particles will never be as high as the pure air intake 71 and hence there will always be assured an abundant supply of pure air to be mixed with the particles in the manner previously described.

While the invention has herein been shown and described in what is conceived to be a practical and effective embodiment, it is recognized that departures may be made therefrom within the scope of the invention, which is not to be limited to the details disclosed herein but is to be accorded the full scope of the claims so as to embrace all equivalent devices.

Having described the invention, what is claimed as new in support of Letters Patent is:

1. A fixture for simulating falling snow particles comprising a reservoir of individual simulated snow particles forming a catch basin with a wall structure sloping laterally inwardly toward a lowermost area, said particles being in quantity forming a mass in said catch basin with a constantly present upper surface above said lowermost area, a pump, a motor having an operating connection to the pump, a distributor conduit connected to the outlet side of the pump, said distributor conduit having constantly open particle outlet means at a fixed location elevated relative to a supporting surface and substantially in vertical alignment with said catch basin, a pump intake conduit of substantially uniform size having a particle inlet means emersed in said mass at a location adjacent said lowermost area of the catch basin and below said upper surface, and a constantly open pure air intake of fixed size in said intake conduit intermediate said particle inlet means and the pump, said air intake having a fixed position exteriorly with respect to said catch basin and below said upper surface, said pure air intake is a port exceeding the particle inlet means in size and is located at a level below said upper surface of the mass of particles and at substantially the same level as said particle inlet means.

2. A fixture for simulating falling snow as in claim 1 wherein the pure air intake is a port opening through the side of the intake conduit.

3. A fixture for simulating falling snow as in claim 1 wherein the particle inlet means comprises a plurality of upwardly facing separate openings spaced from each other adjacent said lowermost area and surrounding the distributor conduit.

4. A fixture for simulating falling snow particles as in claim 1 wherein the distributor conduit is a vertically extending tube with a particle outlet opening at the top and a downwardly directed deflector mounted on the tube over said particle outlet opening.

5. A fixture according to claim 1 wherein said simulated snow particles comprise a foamed synthetic plastic resin in the form of beads and a mixture of powdered talc.

6. A fixture according to claim 5 wherein the particles comprise a mixture of foam polystyrene beads and powdered talc in proportions of about one part talc to 40 parts foamed polystyrene by weight.

7. A fixture for simulating falling snow particles comprising a reservoir of individual simulated snow particles forming a catch basin with a wall structure sloping laterally inwardly toward a lowermost area, said particles being in quantity forming a mass in said catch basin with an upper surface above said lowermost area, a pump, a motor having an operating connection to the pump, a distributor conduit connected to the outlet side of the pump, said distributor conduit having particle outlet means at a location elevated relative to a supporting surface and substantially in vertical alignment with said catch basin, a pump intake conduit having a particle inlet means adjacent said lowermost area of the catch basin and below said upper surface, and a pure air intake in said conduit intermediate said particle inlet means and the pump, said pure air intake being located exteriorly with respect to said catch basin, the distributor conduit being a vertically extending tube with a particle outlet opening at the top and a downwardly directed deflector mounted on the tube over said particle outlet opening, and wherein said tube extends to a position of support on said supporting surface and there is a stand at the lower end of said tube for laterally supporting said tube on the supporting surface and said catch basin is carried by said tube.

* * * * *